US005575741A

United States Patent [19]

Fan

[11] Patent Number: 5,575,741

[45] Date of Patent: Nov. 19, 1996

[54] EXERCISE MECHANISM FOR SIMULATING HORSE RIDING TYPE AND ROWING TYPE EXERCISES

[76] Inventor: Robert Fan, No. 7, Industry North Road 2, Nan Kang Industrial Zone, Nan Tou City, Nan Tou County, Taiwan

[21] Appl. No.: 568,785

[22] Filed: Dec. 7, 1995

[51] Int. Cl.[6] ..... A63B 21/04

[52] U.S. Cl. ..... 482/72; 482/95; 482/96; 482/57

[58] Field of Search ..... 482/72, 95, 96, 482/57, 51, 71, 111; 472/110, 106; 280/1.182, 1.183, 1.192, 1.203, 1.204

[56] References Cited

U.S. PATENT DOCUMENTS

| | | | |
|---|---|---|---|
| 1,952,548 | 3/1934 | Hayes | 482/72 |
| 3,380,737 | 4/1968 | Elia et al. | 482/95 |
| 3,446,503 | 5/1969 | Lawton | 482/72 |
| 5,342,269 | 8/1994 | Huang et al. | 482/95 |
| 5,356,358 | 10/1994 | Chen | 482/57 |
| 5,512,027 | 4/1996 | Chen | 482/95 |

FOREIGN PATENT DOCUMENTS

| | | | |
|---|---|---|---|
| 0497059 | 5/1930 | Germany | 482/72 |
| 0498342 | 5/1930 | Germany | 482/72 |
| 2133298 | 7/1984 | United Kingdom | 482/72 |

*Primary Examiner*—Jerome Donnelly
*Attorney, Agent, or Firm*—Charles E. Baxley, Esq.

[57] ABSTRACT

An exercise mechanism includes a pair of foot posts having a lower end pivotally coupled to a base. A seat post has a front end pivotally coupled to the base and has a shaft rotatably secured to the middle portion. An extension is extended from the shaft and rotated in concert with the shaft. A lever has a middle portion pivotally coupled to the base at an axle and has a rod secured in the rear end and slidably engaged beneath the seat post. A link pivotally couples the lever to the foot post. A bar is pivotally coupled between the extension and the rod for moving the rod relative to the shaft and for rotating the lever about the axle. A pair of handles have a lower portion secured to the shaft for rotating the shaft and the extension. The rear end of the seat post is moved upward and downward by the rod when the lever is rotated about the axle by the extension.

4 Claims, 4 Drawing Sheets

EXERCISE MECHANISM FOR SIMULATING HORSE RIDING TYPE AND ROWING TYPE EXERCISES

BACKGROUND OF THE INVENTION

1. Field of the Invention

The present invention relates to an exercise mechanism, and more particularly to an exercise mechanism for simulating horse riding type and rowing type exercises.

2. Description of the Prior Art

Various kinds of horse riding type and rowing type exercise mechanisms have been developed. However, the exercise mechanisms may be provided for simulating horse riding type and rowing type respectively and may not be used for both types of exercise mechanisms. In addition, the exercise mechanisms may not be adjusted according to the sizes of the users.

The present invention has arisen to mitigate and/or obviate the afore-described disadvantages of the conventional exercise mechanisms.

SUMMARY OF THE INVENTION

The primary objective of the present invention is to provide an exercise mechanism which may be used for simulating both horse riding type and rowing type exercises.

The other objective of the present invention is to provide an exercise mechanism which may be adjusted to different sizes according to the sizes of the users.

In accordance with one aspect of the invention, there is provided an exercise mechanism for simulating horse riding type exercise and rowing type exercise, the exercise mechanism comprises a base including a middle axle, a middle front axle and a front axle, a foot post means including a lower portion pivotally coupled to the base at the middle front axle and including a foot support means secured thereto, a seat post means including a front end pivotally coupled to the base at the front axle and including a rear end having a seat cushion secured thereon and including a middle portion having a shaft rotatably secured thereto, the shaft including an extension means extended therefrom and rotated in concert with the shaft, a lever means including a middle portion pivotally coupled to the base at the middle axle and including a front end and a rear end, the lever means including a rod means secured in the rear end thereof and slidably engaged beneath the rear end of the seat post means, a link means pivotally coupling the front end of the lever means to the foot post means, a bar means pivotally coupled between the extensions and the rod means so as to allow the extension means to move the rod means relative to the shaft and to rotate the lever means about the middle axle, and a pair of handle means including a lower portion secured to the shaft for rotating the shaft and the extension means. The rear end of the seat post means is moved upward and downward by the rod means when the lever means is rotated about the middle axle by the extension means.

The shaft includes two ends each having a U-shaped coupler secured thereto, the lower portions of the handle means are pivotally coupled to the couplers and rotatable toward and away from each other so as to simulate rowing type exercise.

The foot post means includes a bracket means secured thereto and having at least two holes formed therein, the link means includes a first end secured to the bracket means at either of the holes so as to adjust a relative position between the lever means and the foot post means.

The link means includes a link having a first end pivotally secured to the foot post means and having a second end, the second end of the link includes a plurality of holes formed therein, the link means includes a sleeve having a first end pivotally coupled to the front end of the lever means and having a second end slidably engaged on the second end of the link, and the link means includes a bolt means secured to the sleeve and engaged with either of the holes of the link so as to secure the sleeve to the link and so as to allow the sleeve to be adjusted relative to the link.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
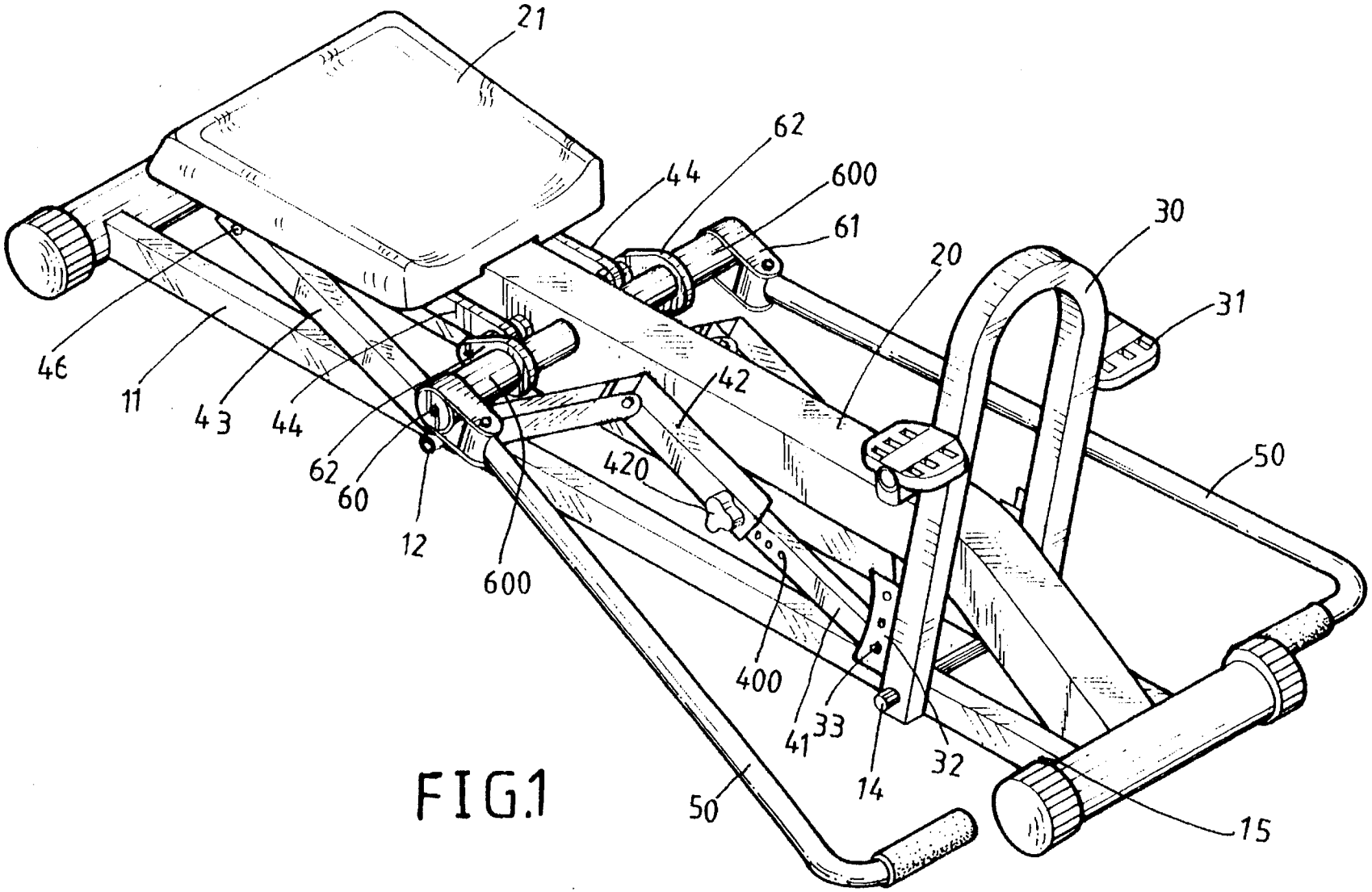
FIG. 1 is a perspective view of an exercise mechanism in accordance with the present invention.
Figure 2:
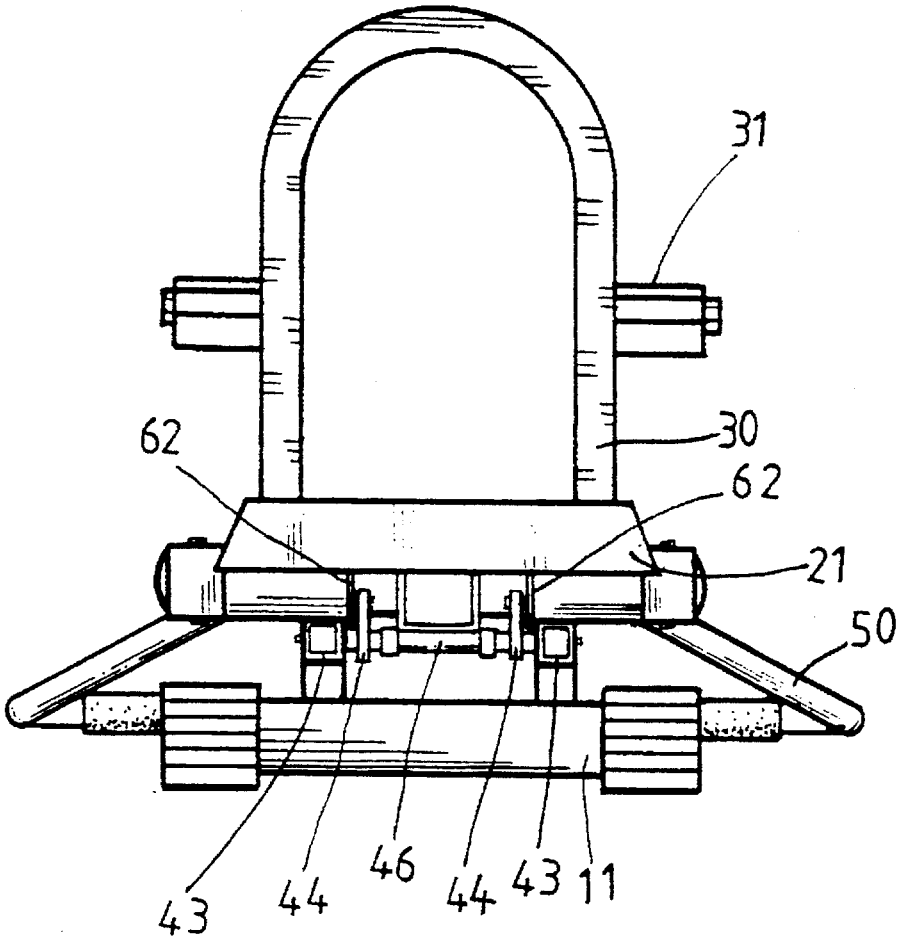
FIG. 2 is a rear view of the exercise mechanism.
Figure 3:
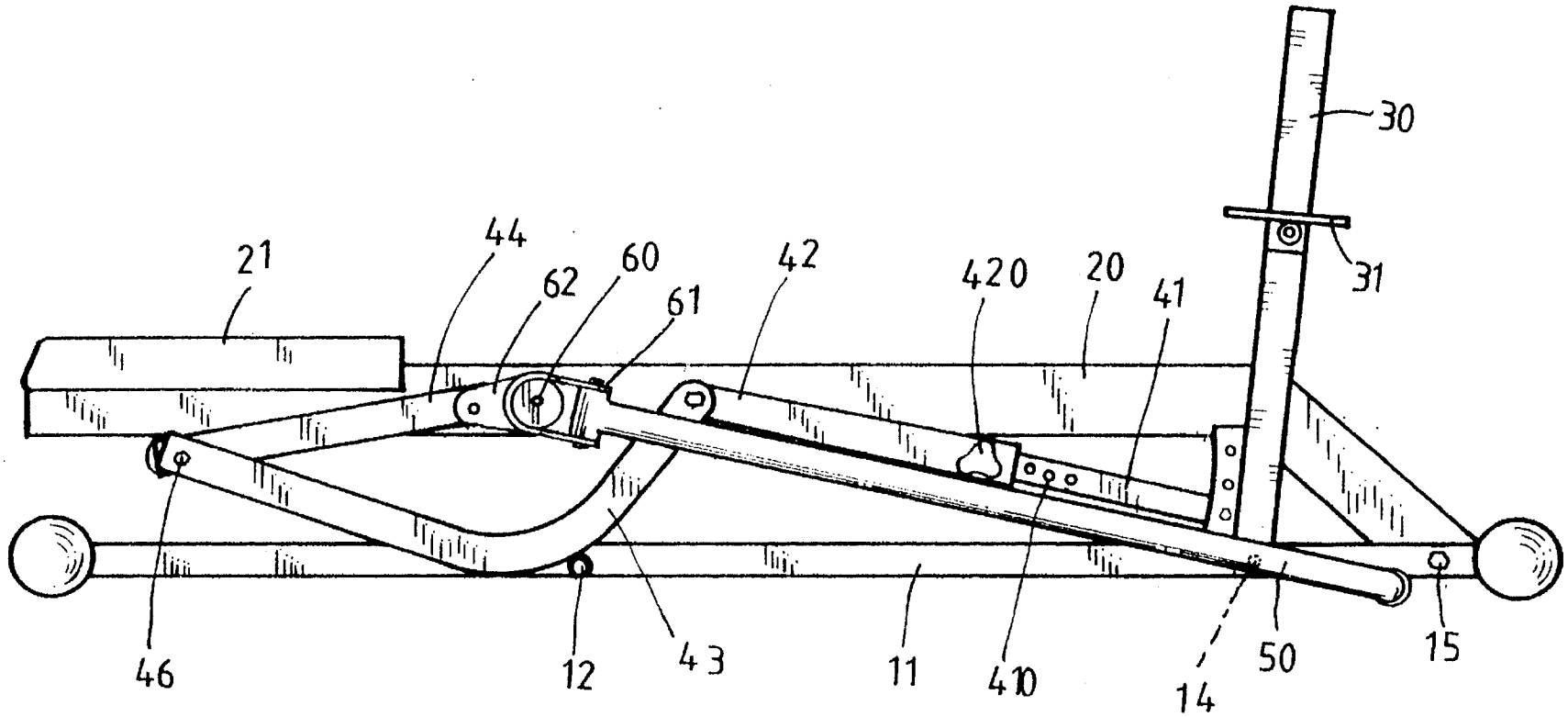
FIGS. 3 and 4 are plane views illustrating the operation of the exercise mechanism.

Referring to FIGS. 1 to 3, an exercise mechanism in accordance with the present invention is provided for simulating both horse riding type and rowing type exercises. The exercise mechanism comprises a base 11 including a middle axle 12, a middle front axle 14, and a front axle 15. A pair of foot posts 30 have a lower portion pivotally coupled to the base 11 at the middle front axle 14 and each has a foot support 31. The foot posts 30 each includes a bracket 32 secured to the lower portion. The brackets 32 each includes two or more holes 33 formed therein. A seat post 20 includes a front end pivotally coupled to the base 11 at the front axle 15 and includes a seat cushion 21 secured to the rear end and includes a shaft 60 secured to the middle portion. A pair of sleeves 600 are rotatably engaged on the shaft 60 and each includes a U-shaped coupler 61 secured to the end portion thereof and each includes an extension 62 secured to the middle portion thereof and rotated in concert with the sleeves 600 respectively. A pair of handles 50 have a lower portion pivotally coupled to the couplers 61 respectively. The U-shaped couplers 61 are arranged to allow the handles 50 to rotate toward each other and to rotate away from each other.

A pair of levers 43 include a curved shape having a middle and lower portion pivotally coupled to the base 11 at the middle axle 12. A pair of bars 44 have one end pivotally coupled to the rear ends of the levers 43 at a rod 46 and have the other end pivotally coupled to the extensions 62 such that the levers 43 may be caused to rotate about the middle axle 12 when the rod 46 is moved toward or away from the shaft 60 and when the extensions 62 are rotated by the handles 50. The front ends of the levers 43 are coupled to the brackets 32 of the foot posts 30 by a pair of links 41. The links 41 each includes a number of holes 410 formed therein for engaging with a bolt 420. A pair of sleeves 42 each has one end pivotally coupled to the front ends of the levers 43 and each has the other end slidably engaged on the respective links 41. The bolts 420 are engaged with the sleeves 42 and are engaged with either of the holes 410 such that the distance between the front ends of the levers 43 and the brackets 32 may be adjusted. As best shown in FIG. 3, the rod 46 is rotatably and slidably engaged beneath the seat post 20 such that the rear end of the seat post 20 may be elevated by the rod 46 when the rear ends of the levers 43 are rotated upward about the middle axle 12.

Figure 4:
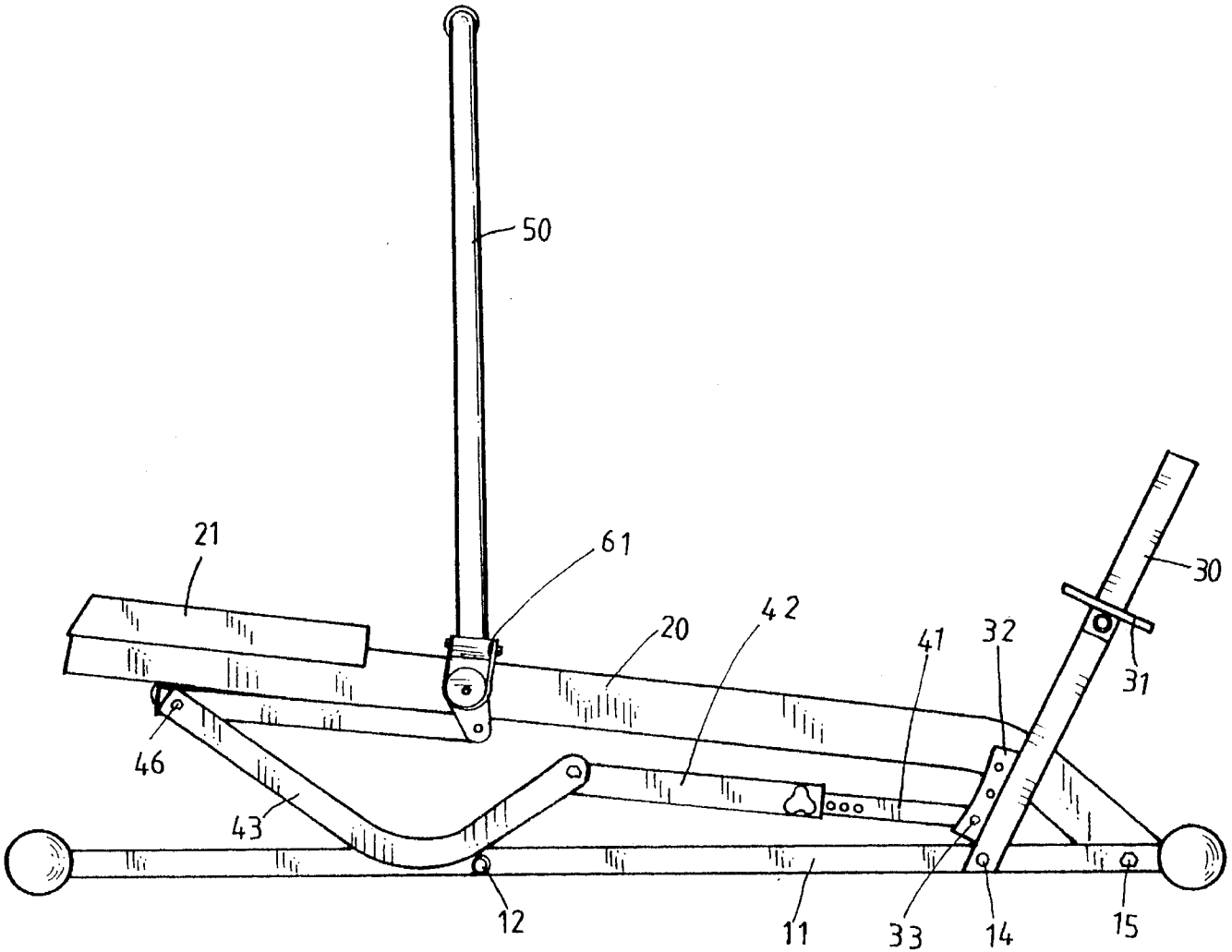

In operation, as shown in FIGS. 3 and 4, when the handles 50 are rotated about the shaft 60 in order to rotate the extensions 62, the levers 43 may be caused to rotate about the middle axle 12 by the bars 44 such that the rear end of the seat post 20 may be moved upward by the rod 46, and such that the users have to spend energy in order to overcome the weight of the users applied to the seat cushion 21. The movement of the handles 50 is similar to the horse riding type exercise. In addition, the handles 50 may be moved toward each other and may be moved away from each other such that the users may also simulate the rowing type exercise.

It is to be noted that the front ends of the links 41 may be adjusted relative to the brackets 32; and the sleeves 42 may be adjusted along the links 41 so as to adjust the relative distances between the front ends of the levers 43 and the foot posts 30, such that the movement of the levers 43 relative to the seat post 20 may also be adjusted according to the user's strength.

Accordingly, the exercise mechanism of the present invention may be used for simulating both horse riding type and rowing type exercises, and may be adjusted to different sizes according to the sizes of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise mechanism for simulating horse riding type exercise and rowing type exercise, said exercise mechanism comprising:

a base including a middle axle, a middle front axle and a front axle, a foot post means including a lower portion pivotally coupled to said base at said middle front axle and including a foot support means secured thereto, a seat post means including a front end pivotally coupled to said base at said front axle and including a rear end having a seat cushion secured thereon and including a middle portion having a shaft rotatably secured thereto, said shaft including an extension means extended therefrom and rotated in concert with said shaft, a lever means including a middle portion pivotally coupled to said base at said middle axle and including a front end and a rear end, said lever means including a rod means secured in said rear end thereof and slidably engaged beneath said rear end of said seat post means, a link means pivotally coupling said front end of said lever means to said foot post means, a bar means pivotally coupled between said extensions and said rod means so as to allow said extension means to move said rod means relative to said shaft and to rotate said lever means about said middle axle, and a pair of handle means including a lower portion secured to said shaft for rotating said shaft and said extension means, said rear end of said seat post means being moved upward and downward by said rod means when said lever means is rotated about said middle axle by said extension means.

2. An exercise mechanism according to claim 1, wherein said shaft includes two ends each having a U-shaped coupler secured thereto, said lower portions of said handle means are pivotally coupled to said couplers and rotatable toward and away from each other so as to simulate rowing type exercise.

3. An exercise mechanism according to claim 1, wherein said foot post means includes a bracket means secured thereto and having at least two holes formed therein, said link means includes a first end secured to said bracket means at either of said holes so as to adjust a relative position between said lever means and said foot post means.

4. An exercise mechanism according to claim 1, wherein said link means includes a link having a first end pivotally secured to said foot post means and having a second end, said second end of said link includes a plurality of holes formed therein, said link means includes a sleeve having a first end pivotally coupled to said front end of said lever means and having a second end slidably engaged on said second end of said link, and said link means includes a bolt means secured to said sleeve and engaged with either of said holes of said link so as to secure said sleeve to said link and so as to allow said sleeve to be adjusted relative to said link.

* * * * *